US005524521A

United States Patent [19]

Clift et al.

[11] Patent Number: 5,524,521

[45] Date of Patent: Jun. 11, 1996

[54] METHOD AND APPARATUS FOR OPTICALLY DETERMINING NOTE CHARACTERISTICS IN A KEYBOARD OPERATED MUSICAL INSTRUMENT

[75] Inventors: Pamela K. Clift, Vacaville; Charles R. Lee, Placerville, both of Calif.

[73] Assignee: Burgett, Inc., Sacramento, Calif.

[21] Appl. No.: 395,459

[22] Filed: Feb. 27, 1995

[51] Int. Cl.[6] ..... G10G 3/04

[52] U.S. Cl. ..... 84/462; 84/626; 84/645

[58] Field of Search ..... 84/626, 658, 670, 84/462, 236, DIG. 7, 687, 718, 724

[56] References Cited

U.S. PATENT DOCUMENTS

| | | | |
|---|---|---|---|
| 3,511,569 | 5/1970 | Mackta | 356/28 |
| 3,617,627 | 11/1971 | McLean | 178/17 R |
| 3,799,671 | 3/1974 | Schweizer | 356/28 |
| 3,900,262 | 8/1975 | Baxter | 356/28 |
| 4,037,511 | 7/1977 | Del Castillo | 84/478 |
| 4,362,934 | 12/1982 | McLey | 250/229 |
| 4,468,999 | 9/1984 | Bonanno | 84/DIG. 7 |
| 4,674,069 | 6/1987 | Mizuno | 367/90 |
| 4,686,880 | 8/1987 | Salani et al. | 84/626 |
| 4,736,662 | 4/1988 | Yamamoto | 84/DIG. 7 |
| 4,790,230 | 12/1988 | Sanderson | 84/462 |
| 4,970,928 | 11/1990 | Tamaki | 84/21 |
| 5,194,685 | 3/1993 | Kawamura et al. | 84/670 |
| 5,200,562 | 4/1993 | Kaneko et al. | 84/21 |
| 5,237,125 | 8/1993 | Fields | 84/626 |

*Primary Examiner*—Patrick J. Stanzione
*Attorney, Agent, or Firm*—John P. O'Banion

[57] ABSTRACT

A method and apparatus for accurately sensing key motion in a keyboard operated musical instrument, in which optical emitters and sensors are positioned above the hammer shanks. The optical emitters and sensors are arranged on a plurality of individually addressable sensor boards, and the sensor boards are divided into a plurality of individually addressable sensor banks. Each sensor board is independently and sequentially activated by a controller according to a specified timing sequence. As the controller activates a sensor board in one bank, allowing the board to warm up, another sensor board in the second bank, which has previously been activated and warmed up, is read and analyzed by the controller. Activation and reading of sensor boards alternates between sensor banks as the sensor boards are sequenced through. This overlapping of sensor board activation and reading, which is made possible by the preferred arrangement of the dual sensor banks as well as the data acquisition method employed, provides for a higher throughput of data conversion than has been heretofore achieved, and thus more efficient sensing and recording of musical expression information from keyboard instruments than has been previously attained.

8 Claims, 6 Drawing Sheets

FIG. – 1
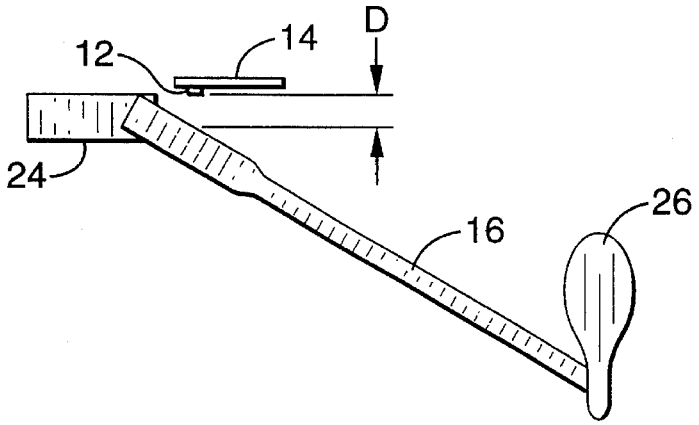
FIG. – 2
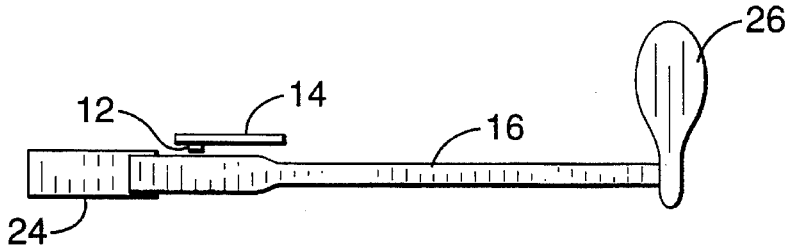
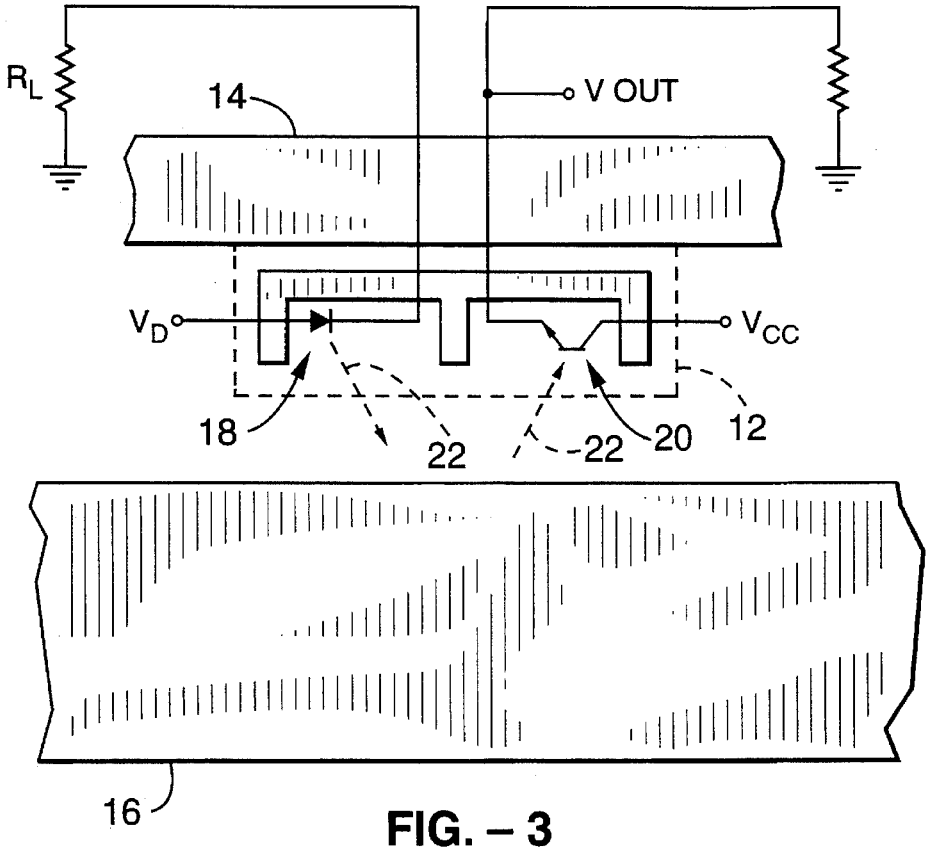
FIG. – 3

METHOD AND APPARATUS FOR OPTICALLY DETERMINING NOTE CHARACTERISTICS IN A KEYBOARD OPERATED MUSICAL INSTRUMENT

BACKGROUND OF THE INVENTION

1. Field of the Invention

This invention pertains generally to sensing key motion in keyboard operated musical instruments, and more particularly to a method and apparatus for dynamically sensing the position of a hammer shank in a piano and determining velocity and duration characteristics of a played note for electronic recording.

2. Description of the Background Art

Accurate recording of musical expression from a keyboard operated musical instrument such as a piano has long been of interest to musicians, composers, and listeners. Early versions of recording devices punched holes in paper ribbons or rolls for reproduction of musical notes by a "player piano." Advances in electronic and optical technologies have led to the development of more sophisticated and accurate sensing and recording means for keyboard instruments.

The availability of inexpensive and increasingly powerful data processing devices has further propelled development of keyboard recording systems. Sensing and recording systems now exist which are interfaced with microprocessors, with electronically or optically generated key information being digitized and interpreted by software. A standardized communication format for such software has been developed in the music industry under the name Musical Instrument Digital Interface or "MIDI."

Several devices, systems, and methods employing electronic or optical sensors on keyboard instruments are known. For example, U.S. Pat. No. 3,617,627 discloses a code converter suitable for use with a keyboard wherein a plurality of code bars corresponding to keys are mounted above a plurality of light channels. Depression of the code bars blocks the light from the light channels from reaching photocells.

U.S. Pat. No. 4,073,511 discloses a teaching device for attachment to an organ in which an aperture-containing record sheet is moved between a light source and fiber optic connectors. The fiber optic ends project light onto keys in accordance with the apertures recorded in the moving sheet.

U.S. Pat. No. 4,362,934 discloses a velocity sensing device using opto-electronic switches in which movement of keys on a musical synthesizer keyboard actuate flags. The flags block or expose light to detectors according to the position of the keys.

U.S. Pat. No. 4,468,999 discloses a programmable synthesizer having a keyboard which develops an expression signal representing pressure on the keys by detecting the change in path length of an infrared light signal.

U.S. Pat. No. 4,736,662 discloses an optical sensor for sensing displacement speed or displacement of a moveable element in a musical instrument, wherein light emitted from a source is guided via optical fiber to a detector. Movement of elements of the musical instrument actuate shutters which permit or prevent transmission of the emitted light to the detectors.

U.S. Pat. No. 4,674,069 discloses a system for collecting and processing data relating to moving bodies in which a frequency modulated ultrasonic wave is transmitted towards a moving body and the wave reflected therefrom is received by a detector and frequency demodulated. A signal representing the moving body is obtained using the frequency variation of the transmitted and received waves.

U.S. Pat. No. 4,790,230 discloses a low profile keyboard device and system for recording and scoring music comprising modular recording devices which are attached adjacent the keys of a keyboard. Key expression data is obtained by reflective couplers on the modular devices which reflect light off the keys. The expression data is then processed for scoring and recording.

U.S. Pat. No. 5,099,738 discloses a MIDI musical translator having a plurality of force sensitive transducers in a keyboard arrangement. The keyboard is electronically scanned, and the information relating to the velocity of the key depression is recorded and converted to standardized MIDI information to be used for subsequent musical tone generation.

U.S. Pat. No. 5,200,562 discloses a key position computing apparatus and method therefor which includes optical sensing devices for each key to detect key movement. Information from the sensing devices is processed to determine key positions.

U.S. Pat. No. 5,237,125 discloses a method and apparatus for measuring velocity of key motion in a keyboard operated musical instrument wherein sensors having a polymeric piezoelectric film are mounted proximate to keys on a keyboard. Upon deflection of the keys, the sensors produce an output which is digitized and processed to create musical information according to detected key velocities.

As can be seen therefore, a variety of devices, methods, and systems for sensing and recording key movement in keyboard instruments have been developed. The above devices, methods and systems, however, rely on sensing the position and velocity of the keys themselves. Typically, sensors in prior systems are positioned above the keys and point downward, or beneath the keys pointing upward, so as to detect the amount of light reflected back from the keys. Note duration is generally calculated by determining the difference in time from when the key is started to be pressed by the performer and when the key is fully depressed, whereas velocity is determined from the relationship of the distance and time of travel.

A number of deficiencies have become apparent in the aforementioned methods and devices, however. Musical expression information is difficult to sense and record accurately based on the velocity and position of the keys themselves, since key movement may not accurately reflect the musical notes ultimately produced. A particular problem experienced is that musical expression information is especially difficult to sense and record accurately in keyboard instruments in which the keys actuate hammers which strike strings, such as the piano. For example, pianos typically vary in key weight and hammer action from manufacturer to manufacturer. The key distance between the resting position and played position also varies between manufacturers and between different piano designs. A standardized sensing and recording system capable of accurate key expression detection thus cannot be applied to every piano. In order to achieve accurate sensing and recording of key expression, the controlling software for the sensing and recording system must be modified and rewritten for each type of piano, to take into account the variation in the weight, action, and distance traveled by the keys.

Further, certain performance techniques for the piano, such as trills, involve rapid key movement, and generate musical expression which is difficult to measure by key movement. For example, the key movement may be very slight, yet the corresponding hammer action may be substantial, depending upon the individual performer. Thus, accurate musical expression information is difficult or impossible to obtain by sensing key motion.

An additional problem associated with the prior methods and devices is that sensing key motion generally involves sacrificing a portion of the key area to accommodate the sensors. This results in reduced area for performers to work with, and generally detracts from the aesthetics of the piano itself. Further, the difference in reflectivity between the black keys and white keys of a piano must be taken into account and corrected when optical sensing is used. Sensing devices and systems which measure key velocity from the interior of the piano can avoid these problems, but are difficult and time consuming to install, and can require modification of the piano itself.

Yet another drawback of prior methods and devices is that the sensors tend to generate an "on" and "off" type of output from reading key movement, resulting in omission of a great deal of musical expression information.

Regardless of the design or manufacture of a particular piano, however, measurement of the velocity and position of the hammer or hammer shank results in the same degree of accuracy in sensing musical expression. By monitoring the hammer shanks or hammers, the same sensing apparatus and method can be used on each piano without modification, to obtain a high degree of accuracy in sensing and recording of musical information.

Therefore, there is a need for an apparatus and method for sensing and recording musical expression generated by keyboard instruments which accurately records musical expression generated by keyboard instruments such as the piano, which detects motion of the hammer shanks and does not rely on the detection of key motion, which does not require software modification for different designs and manufactures of piano, which is quick and easy to install, which does not sacrifice keyboard space, and which does not detract from the aesthetic appearance of the piano. The present invention satisfies these needs, as well as others, and generally overcomes the deficiencies found in the background art.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, the applicant's claimed invention.

SUMMARY OF THE INVENTION

The present invention pertains generally to a method and apparatus for accurate optical sensing of the motion of the hammer shanks in a piano. The invention is quick and easy to install and use, and can be uniformly applied to pianos of different manufacture and design without requiring modification of the controlling software.

In general terms, the present invention comprises arrays of optical sensors which are positioned adjacent to, and preferably above, the piano hammer shanks. A plurality of sensors are generally arranged on individual sensor boards, with a plurality of sensor boards comprising a sensor bank.

By way of example and not of limitation, the present invention includes eighty-eight optical sensors for detecting motion of each of the eighty-eight hammer shanks in a typical piano. The exact number of sensors would depend on the number of hammer shanks in the particular instrument. Preferably, one to eight optical sensors are mounted on an individual sensor board, with the optical sensors positioned and spaced-apart on the board to corresponding to the spacing between hammer shanks. The sensor boards are preferably arranged into two sensor banks, with each sensor bank comprising six to eight sensor boards. Each of the two sensor banks generally monitors the movement of one half of the eighty-eight hammer shanks.

The sensor boards in each of the two sensor banks are electrically connected together by a common bus, with each of the sensor banks having a separate and independent common bus. Each sensor bank is interfaced with a separate analog to digital or A/D converter which digitizes the analog output of the sensors. The A/D converters are interfaced with controlling data processing means, such as a microprocessor, which directs the activation of each sensor board and acquisition of the sensor data. From this digitized information, the microprocessor generates musical information based on the note velocity and duration sensed from the varying positions of the hammer shank. The musical information may be in MIDI or other digital format, and is stored on electronic storage media.

In operating the invention, each sensor board is independently and sequentially activated by the microprocessor according to a specified timing sequence. As the microprocessor activates a sensor board in one bank, allowing the board to warm up, another sensor board in the second bank, which has previously been activated and warmed up, is read and analyzed by the microprocessor. This overlapping of sensor board activation and reading, which is made possible by the preferred arrangement of the dual sensor banks as well as the data acquisition method employed, provides for a higher throughput of data conversion than has been heretofore achieved, and thus more efficient sensing and recording of musical expression information from keyboard instruments than has been previously attained. An alternative method is to turn both boards on at the same time, then (after a warm up period) read one board immediately followed by a read of the second board. Both methods are acceptable for quick and accurate hammer position measurements.

An object of the invention is to provide an apparatus and method for sensing and recording musical expression from keyboard instruments which optically senses position and velocity of the hammer shanks of keyboard instruments.

Another object of the invention is to provide an apparatus and method for sensing and recording musical expression from keyboard instruments which is quick and easy to install and use.

Another object of the invention is to provide an apparatus and method for sensing and recording musical expression from keyboard instruments which is mounted internally within the keyboard instrument and does not interfere with the musical performer or the aesthetic appearance of the instrument.

Another object of the invention is to provide an apparatus and method for sensing and recording musical expression from keyboard instruments which can be uniformly applied to all designs and manufactures of pianos without requiring modification of the controlling software.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 1 is a side elevational view of a sensor board and sensor mounted above a piano-type hammer shank showing the hammer and hammer shank in the resting position.

FIG. 2 is a side elevational view of the configuration shown in FIG. 1 showing the hammer and hammer shank in the strike position.

FIG. 3 is a schematic detailed view of the sensor shown in FIG. 1 and FIG. 2.

DESCRIPTION OF THE PREFERRED EMBODIMENTS

Figure 4:
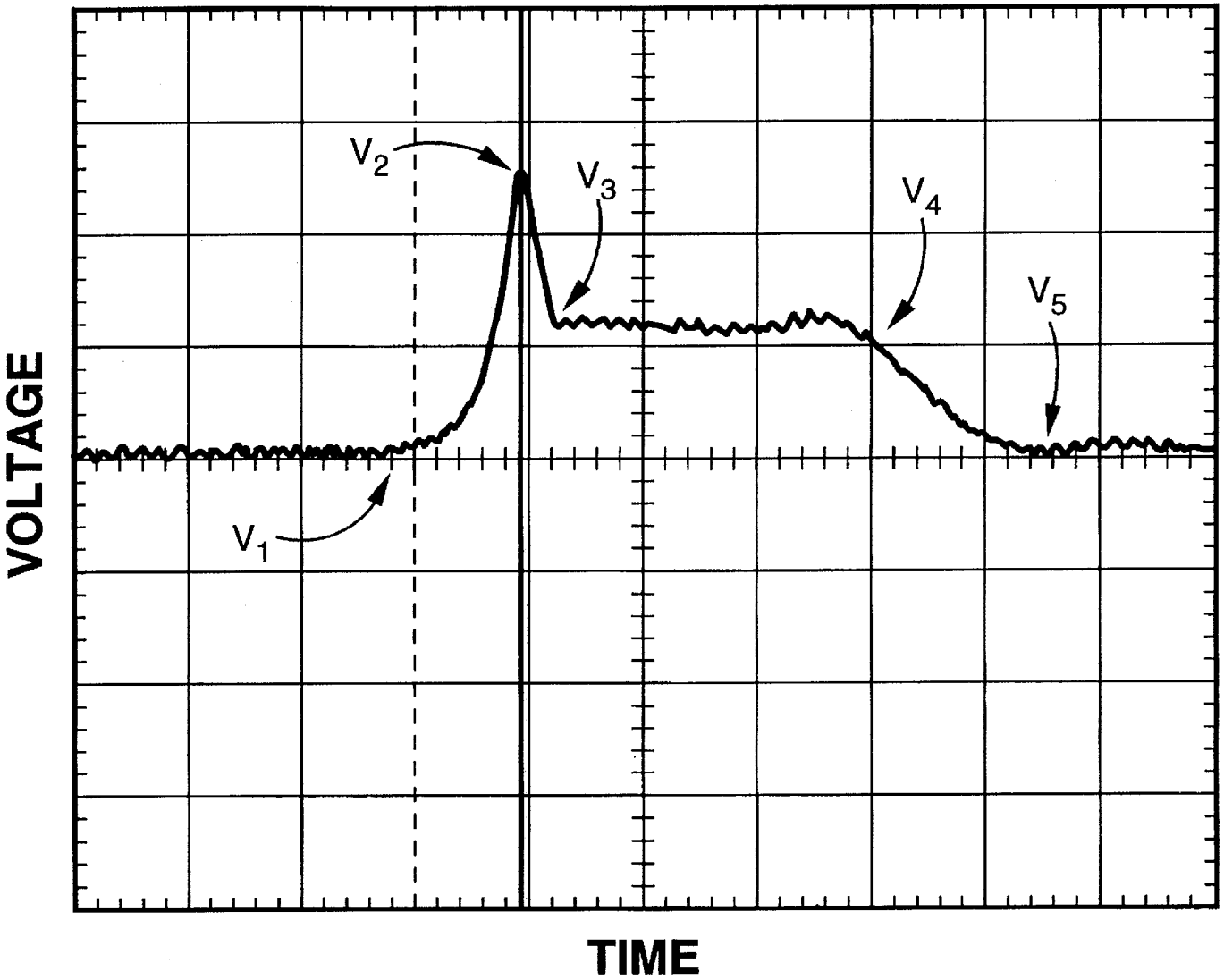
FIG. 4 is a graph showing the relationship of output voltage versus time of the sensor of the present invention as a piano hammer moves from the resting position to the strike position to the kickback position and then again to the rest position.

Referring more particularly to the drawings, for illustrative purposes the present invention is embodied in the method and apparatus for optically sensing and recording hammer shank motion of keyboard musical instruments generally shown in FIG. 1 through FIG. 8. It will be appreciated that the invention may vary as to configuration and as to details without departing from the basic concepts as disclosed herein.

Referring first to FIG. 1 through FIG. 3, an apparatus for optically sensing hammer shank motion of a piano or other keyboard musical instrument in accordance with the present invention includes a plurality of optical sensors 12, each of which is mounted on a sensor board 14 which is in turn mounted above hammer shank 16 as shown. Each optical sensor 12 is generally a single device or package such as a Kodenshi SG107 or the like, which includes two basic components; a light emitting diode or LED 18, which outputs a narrow beam of light, and a photodetector or phototransistor 20. LED 18 is preferably a GaAs or GaAsP type device which emits red light at a wavelength of approximately 980 nanometers. Light 22 is transmitted from LED 18 toward hammer shank 14 where it is intercepted and reflected back toward photodetector 20.

In a typical piano, hammer shank 16 is pivotally coupled to a fixed position flange 24 and travels between a rest position as shown in FIG. 1 and a strike position as shown in FIG. 2 where hammer 26 strikes the piano string (not shown). In the preferred embodiment, sensor boards 14 are mounted at a distance sufficiently above hammer shank 16 that hammer shank 16 does not physically contact sensor 12 when in the strike position (FIG. 2), but not exceeding approximately 0.5 inches when in the rest position (FIG. 1). These criteria generally require sensor 12 be placed proximate to flange 24. At distances D of 0.5 inches or less, sensors 12 can accurately sense reflected light from unmodified wood of hammer shank 16 over its entire range of motion, thus allowing the present invention to be employed on any piano without modification. It will be noted that the addition of a reflective tape or the like (not shown) on hammer shank 16 would permit sensing of hammer shank motion over a greater distance than 0.5 inches thereby allowing sensor 12 to be positioned closer to hammer 26; however it is unnecessary to do so for accurate reproduction when sensors 12 are positioned as shown in FIG. 1 and FIG. 2.

Referring to FIG. 3 and FIG. 4, LED 18 is activated by application of a driving voltage $V_D$ to one of its input terminals, the other input terminal being connected to ground through a current limiting resistor $R_L$. Photodetectors 20, which are coupled to a source voltage $V_{CC}$, turn on and produce an analog DC output voltage $V_{OUT}$ proportional to the amount of reflected light sensed by photodetector 20. As can be seen in FIG. 4, the variation of sensor voltage output over the entire range of hammer shank motion is generally depicted as voltage output versus time. At $V_1$, the hammer shank 20 is in its resting position, as shown in FIG. 1. In this position, hammer shank 16 is at its furthest distance from sensor 12, and thus photodetector 20 produces the lowest voltage output. As a player depresses a key and actuates hammer shank 16, hammer shank 16 begins to accelerate and the distance between hammer shank 16 and sensor 12 decreases, with a corresponding increase in voltage output as more reflected photons reach photodetector 20. At $V_2$, where hammer 26 strikes the string and hammer shank 16 is at its closest approach to sensor 12, the voltage output of photodetector 20 is at its maximum. After a string has been struck by hammer 26, hammer 26 begins to fall to the kickback position, indicated by $V_3$. Hammer shank 16 remains in this position as long as the player keeps the key depressed. Upon releasing the key, shown at voltage output $V_4$, hammer shank 16 beings to fall back to the resting position depicted in FIG. 1, resulting in the voltage output $V_5$ returning to the same level as $V_1$.

Since the distance between sensor 12 and hammer shank 16 is known, the velocity of hammer shank 16 can be determined from that distance and the time elapsing between voltage outputs $V_1$ and $V_2$. This velocity factor corresponds to the strength of the hammer strike and the volume of the tone produced, and thus contains important musical expression information. Similarly, the duration of the hammer strike and thus the musical tone can be determined by the time elapsed between $V_2$ (note on), which corresponds to the actual striking of the string, and $V_5$ (note off), at which point hammer shank 16 returns to its resting position and string vibration is damped. In situations where a player depresses a key with insufficient force to cause the hammer to reach the string, the output voltage level obtained from sensing hammer shank motion will not reach the level of $V_2$, indicating that no musical tone is produced.

Figure 5:
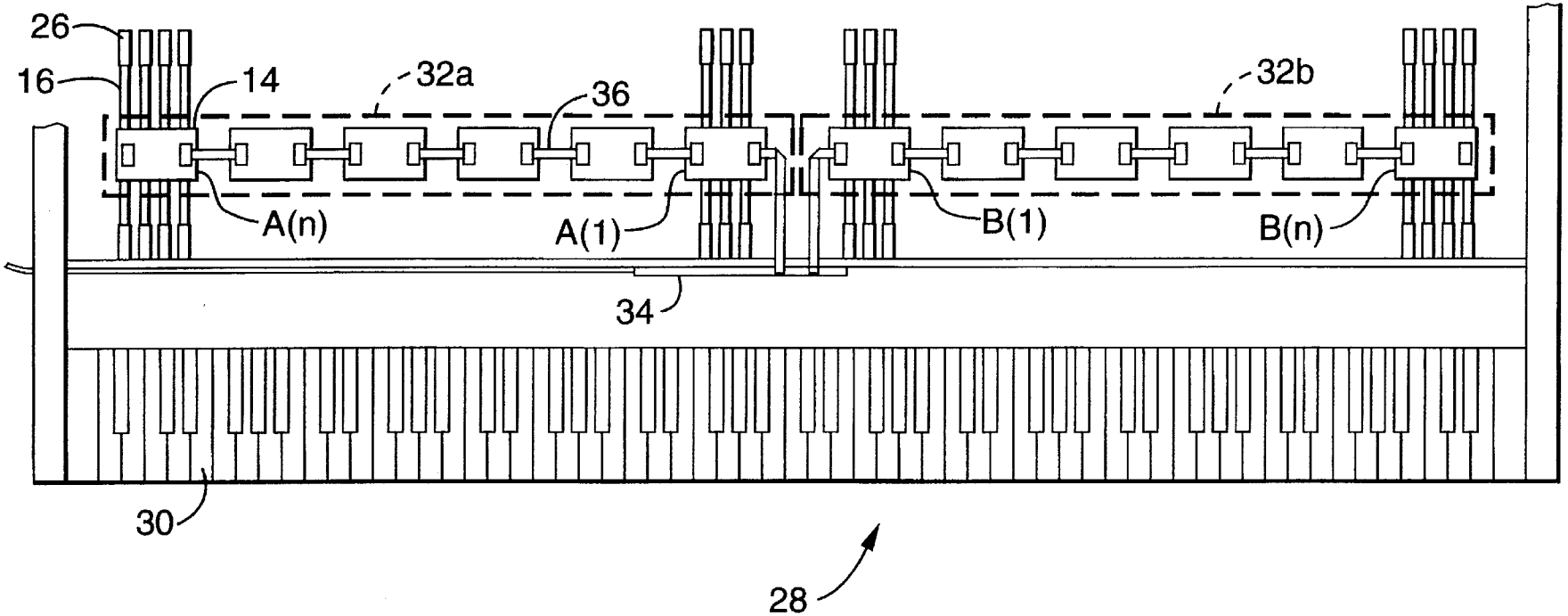
FIG. 5 is a diagrammatic plan view of two banks of sensor boards mounted above the hammer shanks in a piano.

Referring to FIG. 5, a typical full size piano keyboard 28 has eighty-eight keys 30 and eight-eight corresponding hammer shanks 16. Thus, in a full size keyboard musical instrument, and the present invention thus generally employs eighty-eight sensors 12. Each sensor board 14 contains from one to eight sensors 12, and the sensor boards 14 are arranged into a pair of sensor banks **32*a*, 32*b*. Each sensor bank 32*a*, 32*b* contains six to eight sensor boards 14** and senses the motion of one-half of the eighty-eight hammer shanks. Thus, for the typical keyboard musical instrument requiring eighty-eight sensors 12, a variety of combinations of sensors 12 per sensor board 14 and sensor boards 14 per sensor banks 32*a*, 32*b* are possible. Sensor boards 14 are positioned above hammer shanks 16 so that sensors 12 are above the approximate lateral midpoint of the hammer shank. The sensor boards can be attached to a support rail or the like (not shown) which is mounted using the screw locations that are present on the hammer shank assembly in the piano. Since the sensor boards are mounted above the hammer shanks instead of the piano keys, the invention will not interfere with the musician and, further, there is no need to distinguish between black and white keys.

Figure 6:
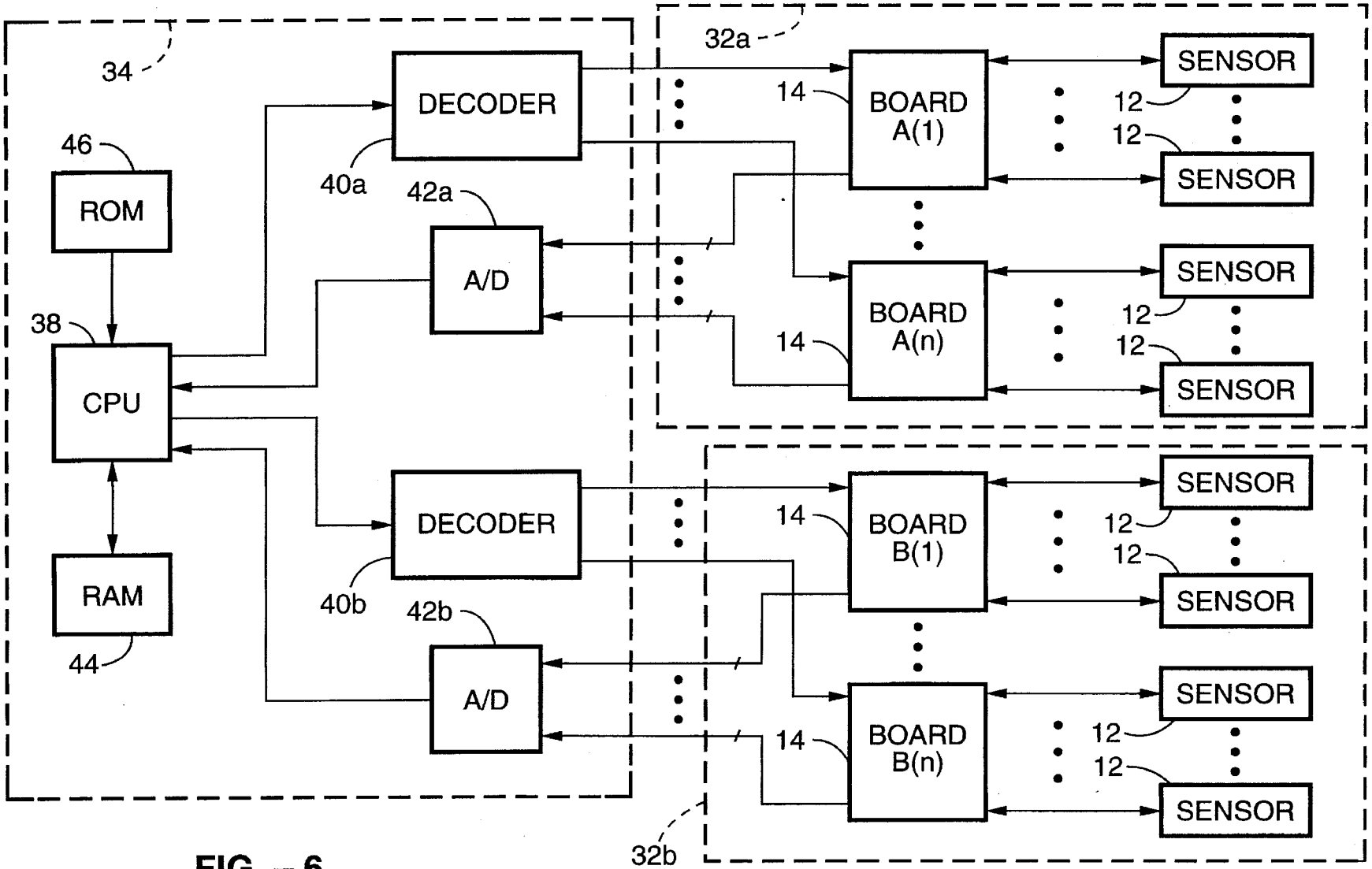
FIG. 6 is a functional block diagram showing the controller processor and sensor configuration of the present invention.

Each sensor board 14 in a sensor bank is individually addressable so that a particular sensor board can be selected by controller 34. Sensor boards 14 are daisy-chained by an interconnecting cable 36, which is ultimately connected to controller 34. Referring also to FIG. 6, controller 34 includes a CPU 38, which is an 8051-type microcontroller or the like. A sensor board 14 in bank 32*a* is addressed by CPU 38 through decoder 40*a* which is a 74HC238 or the like. The voltage outputs of each sensor 12 contained on the sensor board 14 which is so addressed are simultaneously read by a multiplexing A/D convertor 42*a* which is a MAX155 or the like. Similarly, sensor boards in bank 32*b* are addressed through decoder 40*b* and the outputs of the sensors read by A/D convertor 42*b*. Once the sensor voltage outputs are read, the information is stored in RAM 44 and processed by CPU 38. RAM 42 also contains working variables and control programs. CPU 38 monitors the sensor outputs to identify when there have been changes in voltage outputs and the time between those changes. The resulting data is then compared to values in one or more "look-up" tables contained in ROM 46, and is translated to strike velocity (e.g., from the time between $V_1$ and $V_2$ in FIG. 4 and the maximum distance of travel), key position, note duration (e.g., the time between $V_2$ and $V_5$ in FIG. 4) and the like. By making ROM 46 of a flash-type, the "look-up" tables can be updated or modified as desired.

Note that, unlike conventional optical systems, the sensor readings do not simply provide an "on" or "off" state of the hammer. Instead, the sensors provide the full position of the hammer at any given moment. The analog voltage output for the entire range of hammer shank motion shown in FIG. 4 is digitized and processed by controller 34 to produce musical expression information at a level of accuracy which generally cannot be achieved by conventional systems. The resolution of the musical expression information contained in the hammer shank movement is limited only by the capabilities of A/D converters, which is typically 256 positions for an 8 bit A/D converter.

As noted above, when a sensor board is addressed each sensor 12 on that board is simultaneously activated and read by controller 34. The current requirement for this number of sensors operating simultaneously is rather large and, to make the current requirement more practical, it is preferable to pulse the sensors to their on state just before they are read and then turn them off again immediately thereafter. Several sensors may be pulsed on and off together, as long as the total number of sensors on at one time does not exceed the available current. Also, sensors 12 generally require a brief "warm up" time between the time they are pulsed on and the time which their voltage outputs can be read.

Figure 7:
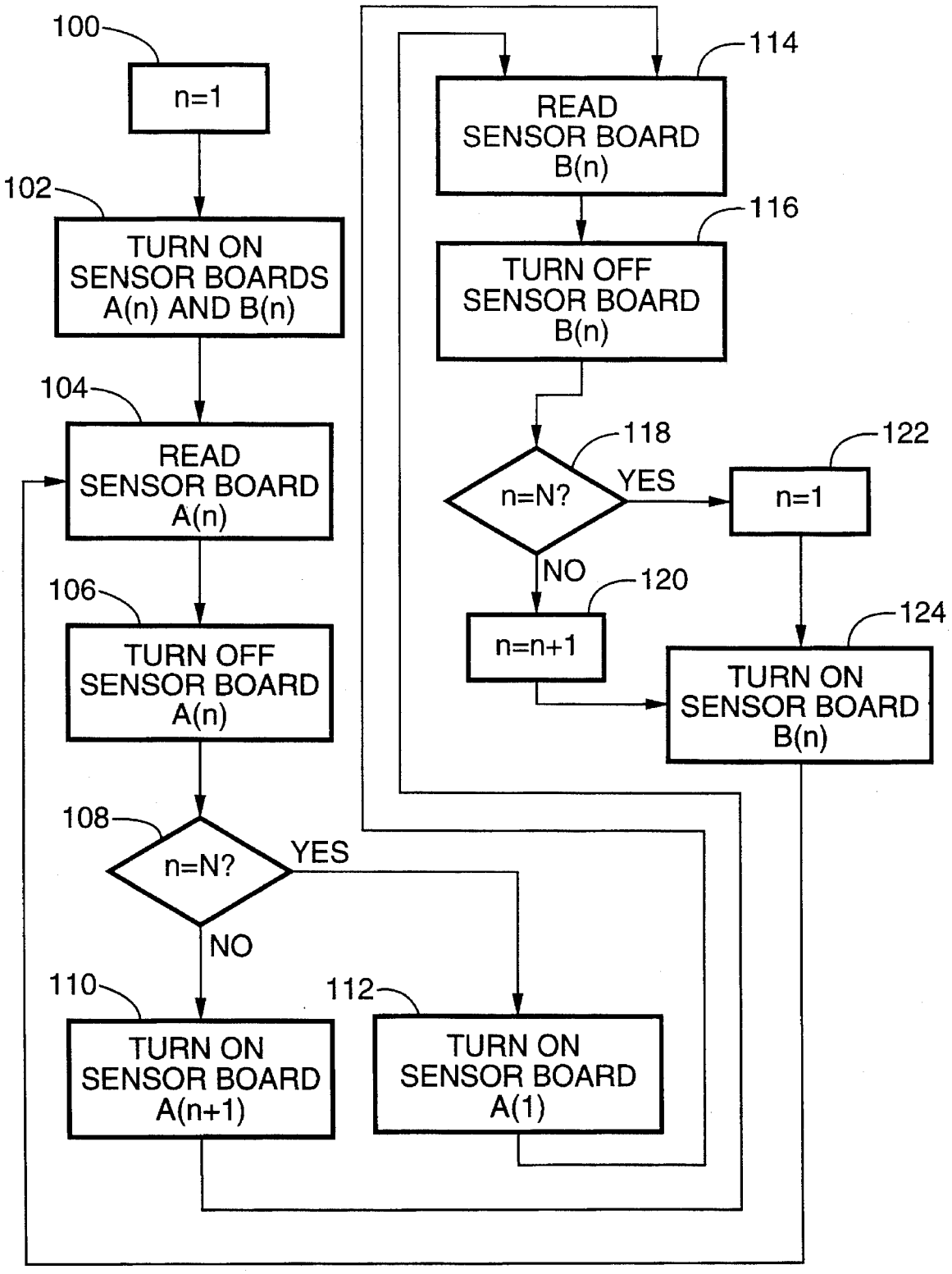
FIG. 7 is a flow chart showing the sensor activation and data acquisition method of the present invention.

Referring also to FIG. 7, controller 34 alternates between sensor banks 32*a*, 32*b* and sequentially activates and reads sensor boards 14 as follows. Designating sensor bank 32*a* as sensor bank A and sensor bank 32*b* as sensor bank B, and assuming that each sensor bank includes a total of N sensor boards, at step 100 the counter n is set to n=1. Next, at step 102, sensor boards A(n) and B(n) are turned on so that they can warm up. Then at step 104, the outputs of the sensors on sensor board A(n) are read. At step 106, sensor board A(n) is turned off. At step 108, the value of counter n is tested against N to determine if all of the sensor boards in sensor bank A have been scanned. If not, at step 110, sensor board A(n+1) is turned on so that it can warm up. Otherwise, sensor board A(1) is turned on at step 112. Next, at step 114, the outputs of the sensors on sensor board B(n) are read. At step 116, sensor board B(n) is turned off. At step 118, the value of counter n is tested against N to determine if all of the sensor boards in sensor bank B have been scanned. If not, at step 120 the value of counter n is incremented to n+1. Otherwise, at step 122 n is reset to n=1. At step 124, sensor board B(n) is then turned on so that it can warm up. This process then continues at step 104.

As can be seen, the data acquisition method of the present invention is designed to have controller 34 select a sensor board to warm up in a first bank, while a sensor board in a second bank, having been previously turned on, can be read and analyzed. After being read, that sensor board in the second bank is turned off, and the next board on the same sensor bank is turned on to warm up. Controller 34 can then read the sensor board in the first bank that was previously turned on. The resultant "overlapping" of sensor boards allows for a high throughput of data. Basically, while one board is being read, another is being warmed up to that it can be immediately read when the first is completed.

Referring again to FIG. 5, in the data acquisition method described above the sensor boards designated as A(1) and B(1) are the preferably the boards in the center of keyboard 28 and closest to controller 34, whereas the sensor boards designated as A(N) and B(N) are the boards at the ends of the chain. Using a scan rate of approximately 25 MHz, the entire keyboard can be scanned in approximately 0.5 μs. Further, if all of the hammer positions are sampled in 1 ms or less, the speed of data acquisition will exceed the maximum possible hammer velocity, so as to provide for an accurate representation of the music being performed. Since A/D convertors 42*a*, 42*b* multiplex the outputs of all of the sensors on a particular sensor board at the same time, data acquisition is further increases.

Accordingly, at selected time intervals a group of sensors are scanned and a mode value is stored which relates to the voltage level sensed. For example, mode 0 would correspond to the rest position ($V_1$), mode 1 would correspond to the key moving down, mode 3 would correspond to the strike position ($V_2$), mode 4 would correspond to the key being held down ($V_3$), mode 5 would correspond to the key returning to its rest position ($V_4$) and mode 6 (or mode 1 again) would correspond to the key in the rest position ($V_5$). Once a hammer starts moving, a count will be accumulated from which velocity can be determined. When the mode is reached indicating a strike has occurred, MIDI or equivalent data will be recorded for that key. Additionally, when the hammer returns to rest, MIDI or equivalent data will be recorded.

Figure 8:
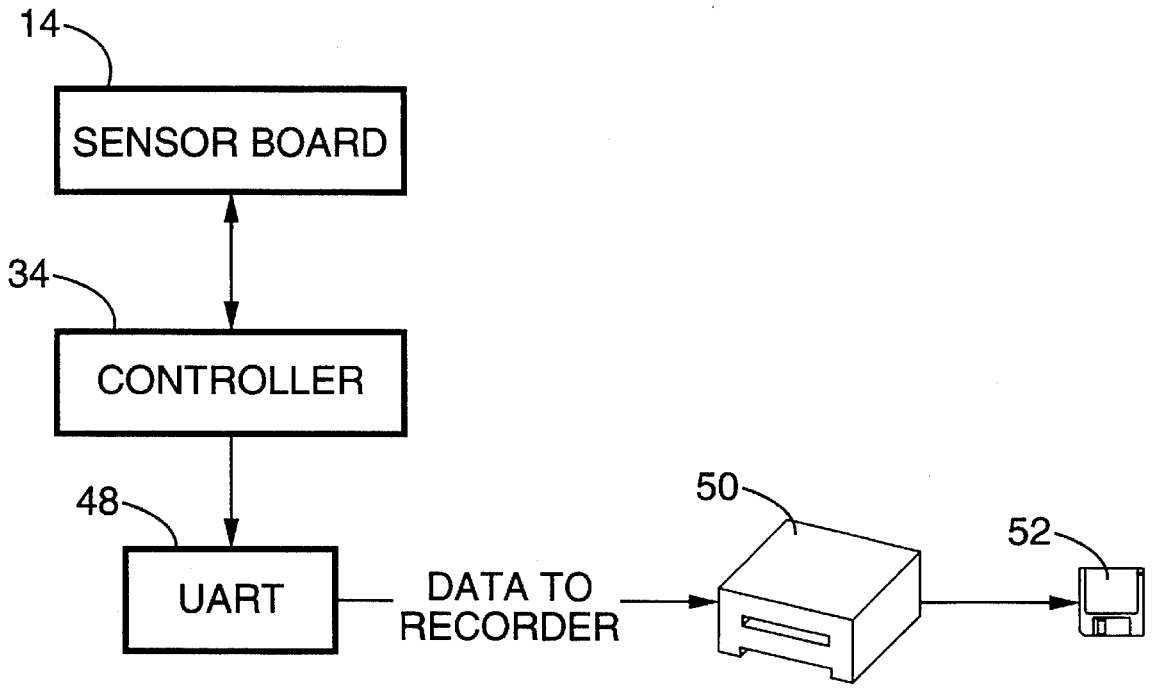
FIG. 8 is a functional block diagram of a musical performance recording apparatus in accordance with the present invention.

Referring to FIG. 8, a conventional UART 48 serves as a communications interface for controller 34 to send data to a recorder 50 for storage on a disk 52. It should be noted, however, that the output data can be presented in any convenient format and that other communications, recording, or storage devices could be used.

While measurement of key movements using conventional devices can produce key velocity and duration results, such measurement presents an inaccurate picture of the actual piano performance. Further, pianos differ in key weights and travel and, therefore, conventional devices must be customized for each piano. The present invention, however, provides for accurately determining piano performance by testing hammer positions as they go through their full motion cycle. By continuously testing the position of the hammer at all times, the complete keyboard performance can be analyzed. Further, the present invention can be fitted to any piano without modification. Also, those skilled in the art will appreciate that the method and apparatus of the present invention could be used to dynamically sense proportional movement of the three foot pedals commonly found on a piano.

Although the description above contains many specificities, these should not be construed as limiting the scope of the invention but as merely providing illustrations of some of the presently preferred embodiments of this invention. Thus the scope of this invention should be determined by the appended claims and their legal equivalents.

We claim:

1. An apparatus for sensing key motion in a keyboard operated musical instrument having a plurality of hammer shanks operated by corresponding keys, comprising:

(a) a plurality of sensor banks, each said sensor bank including a plurality of sensor boards, each said sensor board including a plurality of light emitters and corresponding light sensors, each said light sensor producing an output voltage responsive to intensity of sensed light; and (b) control means for addressing said sensor banks, addressing said sensor boards, activating said light emitters and said light sensors in said addressed sensor boards, acquiring voltage output data from said light sensors in said addressed sensor boards, sequencing between addressing a sensor bank and a sensor board in said addressed sensor bank, and determining key motion characteristics from said acquired output voltage data.

2. An apparatus as recited in claim 1, further comprising means for recording said key motion characteristics on a machine readable storage media.

3. An apparatus for sensing key motion in a keyboard operated musical instrument having a plurality of hammer shanks operated by corresponding keys, comprising:

(a) first and second sensor banks, each said sensor bank including a plurality of sensor boards, each said sensor board including a plurality of light emitters and corresponding light sensors, each said light sensor producing an output voltage responsive to intensity of sensed light; and (b) control means for addressing said first and second sensor banks, sequentially addressing said sensor boards in said sensor banks, activating said light emitters and said light sensors in said addressed sensor boards, acquiring voltage output data from said light sensors in said addressed sensor boards, alternating between addressing a sensor board in said first sensor bank and a sensor board in said second sensor bank, and determining key motion characteristics from said acquired output voltage data.

4. An apparatus as recited in claim 3, further comprising means for recording said key motion characteristics on a machine readable storage media.

5. A method for sensing key motion in a keyboard operated musical instrument having a plurality of hammer shanks operated by corresponding keys, comprising the steps of:

(a) positioning a plurality of sensor boards above said hammer shanks, said sensor boards divided into a plurality of sensor banks, each said sensor board including a plurality of light emitting diodes, each said light emitting diode positioned above a corresponding hammer shank, each said sensor board including a plurality of photosensors, each said photosensor positioned adjacent to a corresponding light emitting diode and above said corresponding hammer shank;

(b) sequentially addressing said sensor banks;

(c) sequentially addressing said sensor boards;

(d) activating said light emitters and said light sensors in said addressed sensor boards;

(e) acquiring voltage output data from said light sensors in said addressed sensor boards (f) sequencing between addressing a sensor bank and a sensor board in said addressed sensor bank; and (g) determining key motion characteristics from said acquired output voltage data.

6. A method as recited in claim 5, further comprising the steps of recording said key motion characteristics on a machine readable storage media.

7. A method for sensing key motion in a keyboard operated musical instrument having a plurality of hammer shanks operated by corresponding keys, comprising the steps of:

(a) positioning a plurality of sensor boards above said hammer shanks, said sensor boards divided into first and second sensor banks, each said sensor board including a plurality of light emitting diodes, each said light emitting diode positioned above a corresponding hammer shank, each said sensor board including a plurality of photosensors, each said photosensor positioned adjacent to a corresponding light emitting diode and above said corresponding hammer shank;

(b) sequentially addressing said sensor banks;

(c) sequentially addressing said sensor boards;

(d) activating said light emitters and said light sensors in said addressed sensor boards;

(e) acquiring voltage output data from said light sensors in said addressed sensor boards;

(f) alternating between addressing a sensor board in said first sensor bank and a sensor board in said second sensor banks; and (g) determining key motion characteristics from said acquired output voltage data.

8. A method as recited in claim 7, further comprising the steps of recording said key motion characteristics on a machine readable storage media.

* * * * *